US009945272B2

(12) United States Patent
Yokoyama et al.

(10) Patent No.: US 9,945,272 B2
(45) Date of Patent: Apr. 17, 2018

(54) VARIABLE VALVE ACTUATION APPARATUS FOR INTERNAL COMBUSTION ENGINE

(71) Applicants: TOYOTA JIDOSHA KABUSHIKI KAISHA, Toyota-shi (JP); DENSO CORPORATION, Kariya (JP)

(72) Inventors: Yu Yokoyama, Okazaki (JP); Haruhito Fujimura, Nagakute (JP); Yoshiki Endo, Okazaki (JP); Keisuke Hotta, Kariya (JP)

(73) Assignees: TOYOTA JIDOSHA KABUSHIKI KAISHA, Toyota-shi (JP); DENSO CORPORATION, Kariya (JP)

( * ) Notice: Subject to any disclaimer, the term of this patent is extended or adjusted under 35 U.S.C. 154(b) by 85 days.

(21) Appl. No.: 15/219,902

(22) Filed: Jul. 26, 2016

(65) Prior Publication Data

US 2017/0037747 A1 Feb. 9, 2017

(30) Foreign Application Priority Data

Aug. 3, 2015 (JP) ..... 2015-153608

(51) Int. Cl.

| | |
|---|---|
| ***F01L 1/46*** | (2006.01) |
| ***F01L 1/344*** | (2006.01) |
| ***F01L 1/047*** | (2006.01) |

(52) U.S. Cl.

CPC ..... *F01L 1/3442* (2013.01); *F01L 1/047* (2013.01); *F01L 1/46* (2013.01); *F01L 2001/3445* (2013.01); *F01L 2001/34433* (2013.01); *F01L 2250/02* (2013.01); *F01L 2800/17* (2013.01)

(58) Field of Classification Search

CPC ..... F01L 2001/34426; F01L 2001/3443; F01L 2001/34433; F01L 2001/3445; F01L 1/46; F01L 2800/17

USPC ..... 123/90.17

See application file for complete search history.

(56) References Cited

U.S. PATENT DOCUMENTS

2008/0060595 A1 3/2008 Yoshijima et al.

FOREIGN PATENT DOCUMENTS

| | | |
|---|---|---|
| JP | 2006-189010 | 7/2006 |
| JP | 2012-67699 | 4/2012 |

*Primary Examiner* — Jorge Leon, Jr.

(74) *Attorney, Agent, or Firm* — Oblon, McClelland, Maier & Neustadt, L.L.P.

(57) ABSTRACT

In a variable valve actuation apparatus for an internal combustion engine, a rotor of a variable valve timing mechanism is fixed to one end of a camshaft by a plurality of bolts. An oil control valve configured to control hydraulic pressure that acts on the rotor is fixed to the rotor by one or some of the plurality of bolts. For this reason, by releasing fastening of the bolt that fixes the oil control valve to the rotor among the plurality of bolts that fix the rotor to the one end of the camshaft, the oil control valve is allowed to be removed from the rotor while the rotor is fixed to the camshaft. Therefore, it is not required to perform positioning for fixing the rotor to the camshaft at the time of replacement of the oil control valve.

5 Claims, 3 Drawing Sheets

VARIABLE VALVE ACTUATION APPARATUS FOR INTERNAL COMBUSTION ENGINE

INCORPORATION BY REFERENCE

The disclosure of Japanese Patent Application No. 2015-153608 filed on Aug. 3, 2015 including the specification, drawings and abstract is incorporated herein by reference in its entirety.

BACKGROUND OF THE INVENTION

1. Field of the Invention

The invention relates to a variable valve actuation apparatus for an internal combustion engine.

2. Description of Related Art

A variable valve actuation apparatus for an internal combustion engine mounted on a vehicle, such as an automobile, includes a variable valve timing mechanism. The variable valve timing mechanism is hydraulically actuated in order to change the valve timing of an engine valve, such as an intake valve and an exhaust valve.

In the variable valve actuation apparatus for an internal combustion engine, the relative rotation phase of a camshaft with respect to a crankshaft is changed by actuating a movable member of a variable valve timing mechanism fixed to one end of the camshaft by supplying and draining oil to and from the variable valve timing mechanism. In this way, the valve timing of the internal combustion engine is changed by changing the relative rotation phase of the camshaft with respect to the crankshaft.

The variable valve actuation apparatus for an internal combustion engine includes a hydraulic circuit and an oil control valve. The hydraulic circuit connects the variable valve timing mechanism with an oil pump. The oil control valve is provided halfway in a plurality of oil passages that constitute the hydraulic circuit. The oil control valve controls hydraulic pressure that acts on the movable member of the variable valve Liming mechanism. The oil control valve controls hydraulic pressure that acts on the movable member of the variable valve timing mechanism by changing the mode in which oil is supplied to and discharged from the variable valve timing mechanism through the plurality of oil passages that constitute the hydraulic circuit. In this manner, the oil control valve actuates the movable member.

For information, Japanese Patent Application Publication No. 2012-67699 (JP 2012-067699 A) describes a bolt-integrated oil control valve, that is, the function of a bolt that fixes a movable member of a variable valve timing mechanism to a camshaft is added to an oil control valve. The bolt-integrated oil control valve is screw-fastened to one end of the camshaft. Thus, the bolt-integrated oil control valve fixes the movable member of the variable valve timing mechanism to the camshaft.

When the bolt-integrated oil control valve is employed, the length of each of portions of the oil passages of the hydraulic circuit between the oil control valve and the variable valve timing mechanism is reduced. As a result, it is possible to improve the response at the time of hydraulically actuating the movable member of the variable valve Liming mechanism and to prevent or reduce leakage of oil from the portions of the oil passages of the hydraulic circuit between the variable valve timing mechanism and the oil control valve.

However, in the case where the bolt-integrated oil control valve is employed, when the oil control valve is removed for replacement, or the like, fixing of the movable member to the camshaft by screw fastening using the oil control valve is also released, with the result that the movable member is also compelled to be removed from the camshaft.

A fixed position of the movable member in a rotation direction around the axis of the camshaft in the variable valve timing mechanism influences the relative rotation phase of the camshaft with respect to the crankshaft. For this reason, at the time of fixing the movable member, removed as described above, to the camshaft again, the movable member and the camshaft need to be accurately positioned in the rotation direction around the axis of the camshaft.

Therefore, when a replacement oil control valve is fixed to the camshaft by screw fastening together with the variable valve timing mechanism (movable member), the movable member needs to be accurately positioned with respect to the camshaft in the rotation direction around the axis of the camshaft. As a result, work for such positioning takes much effort, so the replacement workability of the oil control valve decreases.

SUMMARY OF THE INVENTION

The invention provides a variable valve actuation apparatus for an internal combustion engine, which is able to prevent or reduce a decrease in the replacement workability of an oil control valve.

A variable valve actuation apparatus for an internal combustion engine includes a variable valve timing mechanism and an oil control valve. The variable valve timing mechanism includes a movable member fixed to one end of a camshaft of the internal combustion engine. The oil control valve is configured to control hydraulic pressure that acts on the movable member. The movable member is fixed to the one end of the camshaft of the internal combustion engine by a plurality of bolts. The oil control valve is fixed to the movable member by one or some of the plurality of bolts.

With the above configuration, by releasing fastening of the bolt that fixes the oil control valve to the movable member among the plurality of bolts that fix the movable member of the variable valve timing mechanism to the one end of the camshaft, the oil control valve is allowed to be removed from the movable member while the movable member is fixed to the camshaft. Therefore, at the time of replacement of the oil control valve, it is not required to remove the movable member of the variable valve timing mechanism from the camshaft, and it is not required to accurately position the movable member and the camshaft at the time of fixing the movable member to the one end of the camshaft again. For this reason, at the time of replacement work for the oil control valve, a decrease in the workability due to the positioning is prevented.

In the variable valve actuation apparatus, the oil control valve may be inserted in an accommodation hole provided at a center of the movable member, and the oil control valve may be fixed to the movable member by pressing the oil control valve into the accommodation hole with a use of a stay fixed to the movable member by the one or some of the plurality of bolts.

In the variable valve actuation apparatus, the stay may have a hole for allowing the one or some of the bolts to extend through the hole, and may have a pair of sandwiching pieces that protrude in a direction perpendicular to an axis of the hole and parallel to each other, and the oil control valve may be positioned with respect to the movable member as a result of plane contact of the sandwiching pieces of the stay with fiat faces of the oil control valve.

In the variable valve apparatus, the oil control valve may be inserted in an accommodation hole provided at a center of the movable member, and the oil control valve may be fixed to the movable member by pressing the oil control valve into the accommodation hole with a use of a head of the one or some of the plurality of bolts via a protrusion of the oil control valve.

In the variable valve actuation apparatus, the protrusion of the oil control valve may protrude from an outer wall of the oil control valve in a direction away from a center line of the oil control valve, a groove in which the protrusion is inserted may be provided on an inner periphery of the movable member, and the oil control valve may be positioned with respect to the movable member by contact of a side wall of the protrusion with a side wall of the groove.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
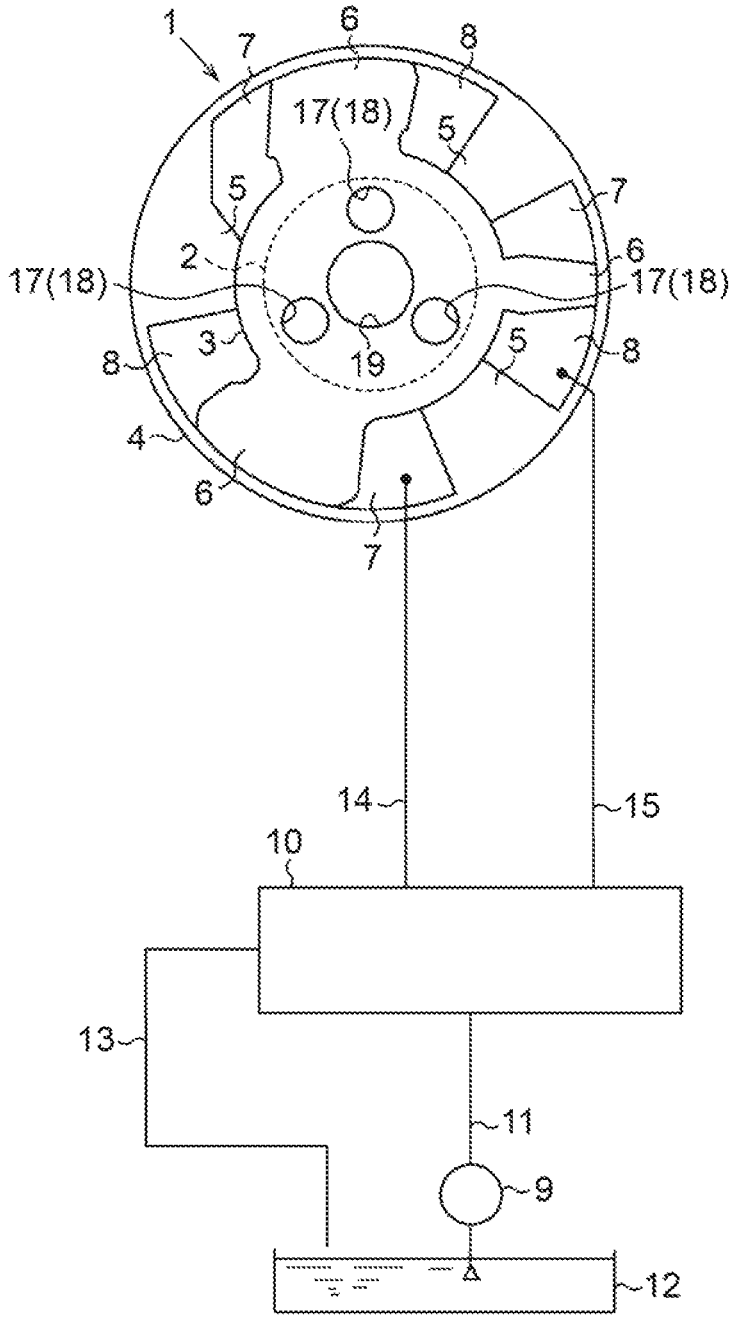
FIG. 1 is a schematic view that shows the overall configuration of a variable valve actuation apparatus for an internal combustion engine.

Hereinafter, an embodiment of a variable valve actuation apparatus for an internal combustion engine will be described with reference to FIG. 1 to FIG. 3. As shown in FIG. 1, the variable valve actuation apparatus for an internal combustion engine includes a variable valve timing mechanism 1. The variable valve timing mechanism 1 is hydraulically actuated in order to change the valve timing of an engine valve. The variable valve timing mechanism 1 includes a rotor 3 and a housing 4. The rotor 3 serves as a movable member, and is fixed to a camshaft (in this example, intake camshaft) 2 that rotates in order to open or close an intake valve that is the engine valve. The housing 4 is located coaxially with the camshaft 2 so as to surround the rotor 3. The rotation of a crankshaft of the internal combustion engine is transmitted to the housing 4.

A plurality of protrusions 5 are provided on the inner periphery of the housing 4 at predetermined intervals in the circumferential direction of the housing 4. The plurality of protrusions 5 protrude toward the axis of the camshaft 2. A plurality of vanes 6 are provided on the outer periphery of the rotor 3 such that each of the vanes 6 is located between the adjacent two of the protrusions 5. Each of the plurality of vanes 6 protrudes in a direction away from the axis of the camshaft 2. Thus, each space located between any two of the protrusions 5 inside the housing 4 is partitioned by a corresponding one of the vanes 6 into an advancing hydraulic chamber 7 and a retarding hydraulic chamber 8.

The variable valve actuation apparatus for an internal combustion engine includes an oil control valve 10. The oil control valve 10 controls the supply and discharge of oil to and from each of the advancing hydraulic chamber 7 and retarding hydraulic chamber 8 of the variable valve timing mechanism 1. The oil control valve 10 includes a hydraulic circuit that connects the variable valve timing mechanism 1 with an oil pump 9.

The oil control valve connected to the oil pump 9 via a supply passage 11, and is connected to an oil pan 12 via a discharge passage 13. The supply passage 11 and the discharge passage 13 constitute the hydraulic circuit. The oil pan 12 is used to store oil that is drawn by the oil pump 9. The oil control valve 10 is connected to the advancing hydraulic chamber 7 of the variable valve timing mechanism 1 via an advancing oil passage 14, and is connected to the retarding hydraulic chamber 8 of the variable valve timing mechanism 1 via a retarding oil passage 15. The advancing oil passage 14 and the retarding oil passage 15 constitute the hydraulic circuit.

As oil is supplied to the advancing hydraulic chamber 7 and oil is discharged from the retarding hydraulic chamber 8 by driving the oil control valve 10, the rotor 3 relatively moves in the right rotation direction in the drawing with respect to the housing 4 under hydraulic pressure that acts on the rotor 3, with the result that the relative rotation phase of the camshaft 2 with respect to the crankshaft advances. As the relative rotation phase of the camshaft 2 with respect to the crankshaft advances, the valve timing of the intake valve advances.

As oil is supplied to the retarding hydraulic chamber 8 and oil is discharged from the advancing hydraulic chamber 7 by driving the oil control valve 10, the rotor 3 relatively moves in the left rotation direction in the drawing with respect to the housing 4 under hydraulic pressure that acts on the rotor 3, with the result that the relative rotation phase of the camshaft 2 with respect to the crankshaft retards. As the relative rotation phase of the camshaft 2 with respect to the crankshaft retards, the valve timing of the intake valve retards.

Next, a mode in which the variable valve timing mechanism 1 is mounted on the camshaft 2 and a mode in which the oil control valve 10 is mounted in the variable valve timing mechanism 1 will be described.

Figure 2:
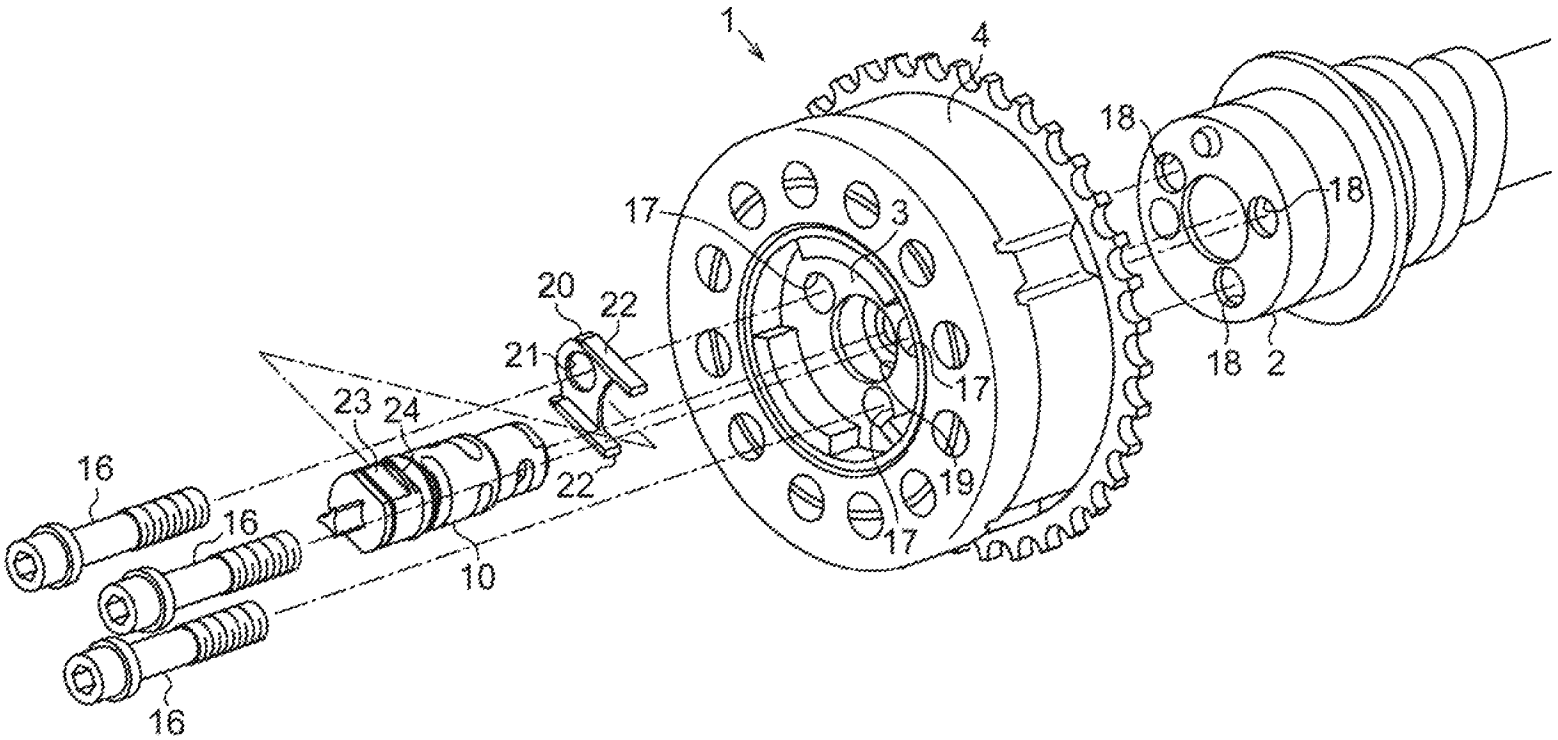
FIG. 2 is an exploded perspective view that shows a mode in which a variable valve timing mechanism is mounted on a camshaft and a mode in which an oil control valve is mounted in the variable valve timing mechanism.

As shown in FIG. 2, the variable valve timing mechanism 1 is fixed to one end of the camshaft 2 by a plurality of (three in this example) bolts 16 arranged at equal intervals around the axis of the camshaft 2. Each of these bolts 16 extends through a corresponding one of holes 17 provided in the rotor 3 of the variable valve timing mechanism 1, and is screwed into a corresponding one of threaded holes 18 provided at one end of the camshaft 2 in that state. By screwing the plurality of bolts 16 to one end of the camshaft 2 in this way, the rotor 3 of the variable valve timing mechanism 1 is fixed to the camshaft 2 by the bolts 16.

The holes 17 of the rotor 3 and the threaded holes 18 of the camshaft 2 are provided at equal intervals around the axis of the camshaft 2 such that, when the rotor 3 is fixed to the camshaft 2 by the bolts 16 as described above, the variable valve timing mechanism 1 (rotor 3) is located along the same axis as the camshaft 2. For information, a fixed position of the rotor 3 of the variable valve timing mechanism 1 in the rotation direction around the axis with respect to the camshaft 2 influences the relative rotation phase of the camshaft 2 with respect to the crankshaft. For this reason, the positions of the threaded holes 18 of the camshaft 2 are set such that, when the rotor 3 is fixed to the camshaft 2 by the plurality of bolts 16, the fixed position of the rotor 3 in the rotation direction around the axis with respect to the camshaft 2 is an appropriate position.

On the other hand, the oil control valve 10 is fixed to the rotor 3 by one or some of (one in this example) the plurality of bolts 16 that fix the rotor 3 of the variable valve timing mechanism 1 to the camshaft 2. The oil control valve 10 is fixed to the rotor 3 such that the oil control valve 10 is inserted in an accommodation hole 19 provided at the center of the rotor 3 and is pressed into the accommodation bole 19 by a stay 20 fixed to the rotor 3 by one of the bolts 16. The advancing oil passage 14 and the retarding oil passage 15 shown in FIG. 1 are provided in the rotor 3. The supply passage 11 and the discharge passage 13 shown in FIG. 1 are provided in the rotor 3 and the camshaft 2. The advancing oil passage 14, the retarding oil passage 15, the supply passage 11 and the discharge passage 13 communicate with the accommodation hole 19 of the rotor 3 shown in FIG. 2, and are connected to the oil control valve 10 fixedly pressed into the accommodation hole 19.

Next, the detailed structure of the oil control valve 10 and stay 20 for fixing the oil control valve 10 to the rotor 3 will be described. The stay 20 has a hole 21 for allowing the bolt 16 to extend therethrough, and has a pair of sandwiching pieces 22 that protrude in a direction perpendicular to the axis of the hole 21 and that are parallel to each other. On the other hand, flat faces 23 are provided at a portion of the outer wall of the oil control valve 10 and the portion is sandwiched by the pair of sandwiching pieces 22 of the stay 20. The flat faces 23 are respectively in plane contact with the sandwiching pieces 22. One of the flat faces 23 of the outer wall of the oil control valve 10 is on the opposite side of the center line of the oil control valve 10 from the other of the flat faces 23 (only one of the flat faces 23 is shown in the drawing). A flange 24 projects from the rotor 3-side edges of the flat faces 23. The flange 24 contacts with the sandwiching pieces 22 in the center line direction of the oil control valve 10 when the pair of sandwiching pieces 22 sandwich the portion corresponding to the flat faces 23 of the oil control valve 10.

In order to fix the oil control valve 10 to the rotor 3 by the bolt 16 and the stay 20, initially, the rotor 3 (variable valve timing mechanism 1) is fixed to the camshaft 2 by the other bolts 16. That is, in a state where the holes 17 of the rotor 3 are positioned with respect to the threaded holes 18 of the camshaft 2, the bolts 16 are passed through the holes 17 of the rotor 3, and are screwed into the threaded holes 18 of the camshaft 2. By screwing the bolts 16 to the camshaft 2 at two points, the rotor 3 (variable valve timing mechanism 1) is fixed to one end of the camshaft 2. After that, the oil control valve 10 is fixed to the rotor 3 by the bolt 16 and the stay 20.

Figure 3:
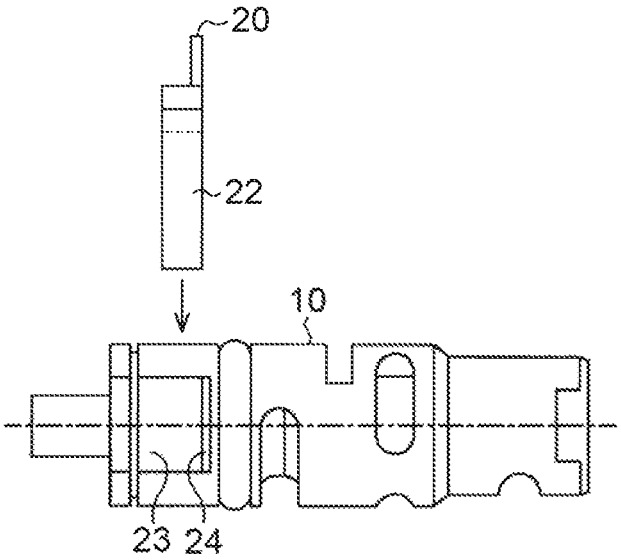
FIG. 3 is a side view that shows the oil control valve and a stay.

More specifically, as shown in FIG. 3, the sandwiching pieces 22 of the stay 20 are located so as to face the flat faces 23 of the oil control valve 10, and the stay 20 is displaced in the arrow direction in the drawing. Thus, the pair of sandwiching pieces 22 (only one of the sandwiching pieces 22 is shown in FIG. 3) sandwich the portion corresponding to the flat fares 23 of the oil control valve 10. At this time, the sandwiching pieces 22 of the stay 20 and the flat faces 23 of the oil control valve 10 are respectively in plane contact with each other, and are set such that the stay 20 and the oil control valve 10 do not relatively rotate around the center line of the oil control valve 10 due to the plane contact.

After that, the oil control valve 10 is inserted into the accommodation hole 19 of the rotor 3, shown in FIG 1, and the hole 21 of the stay 20 is positioned with respect to the hole 17 of the rotor 3. In this state, as the bolt 16 is passed through the hole 21 of the stay 20 and the hole 17 of the rotor 3 and is screwed into the threaded hole 18 of the camshaft 2, the sandwiching pieces 22 of the stay 20 press the flange 24 of the oil control valve 10 through screwing of the bolt 16 to the camshaft 2. As a result, the oil control valve 10 is pressed into the accommodation hole 19 by the stay 20. In this way, when the oil control valve 10 is pressed into the accommodation hole 19, the oil control valve 10 is fixed to the rotor 3 in a state where the oil control valve 10 is positioned with respect to the rotor 3 in the center line direction of the oil control valve 10.

When the stay 20 is fixed to the rotor 3 by the bolt 16, the sandwiching pieces 22 of the stay 20 fixed to the rotor 3 and the flat faces 23 of the oil control valve 10 are respectively in plane contact with each other, with the result that displacement of the oil control valve 10 around the center line is prevented. For this reason, when the oil control valve 10 is fixed to the rotor 3, the oil control valve 10 is positioned with respect to the rotor 3 in the rotation direction around the center line of the oil control valve 10. The position of the oil control valve 10 at this time is a position at which the advancing oil passage 14, the retarding oil passage 15, the supply passage 11 and the discharge passage 13 (all of which are shown in FIG. 1) that communicate with the accommodation hole 19 are connected to the oil control valve 10. That is, the position of the threaded hole 18 into which the bolt 16 for fixing the stay 20 to the rotor 3 is screwed among the threaded holes 18 of the camshaft 2 is set such that the oil control valve 10 is fixed in that position.

On the other hand, at the time of removing the oil control valve 10 fixed to the rotor 3 for replacement, or the like, pressing of the oil control valve 10 into the accommodation hole 19 by the stay 30 is released by loosening the bolt 16 that fixes the stay 20 to the rotor 3 to release screw-fastening of the stay 20 by the bolt 16. In this state, by separating the bolt 16, the stay 20 and the oil control valve 10 from the rotor 3, the oil control valve 10 is pulled out from the accommodation hole 19 and is removed from the rotor 3.

Next, the operation of the variable valve actuation apparatus for an internal combustion engine will be described. By unscrewing the bolt 16 that fixes the oil control valve 10 to the rotor 3 by using the stay 20 among the plurality of bolts 16 that fix the rotor 3 of the variable valve timing mechanism 1 to one end of the camshaft 2, the oil control valve 10 is allowed to be removed from the rotor 3 while the rotor 3 is fixed to the camshaft 2. Therefore, at the time of replacing the oil control valve 10, the rotor 3 of the variable valve timing mechanism 1 does not need to be removed from the camshaft 2. For this reason, at the time of fixing the rotor 3, removed from the camshaft 2, to one end of the camshaft 2 again, it is not required to accurately position the rotor 3 in the rotation direction around the axis of the camshaft 2, so a decrease in the replacement workability of the oil control valve 10 for positioning is prevented or reduced.

According to the present embodiment described in detail above, the following advantageous effects are obtained.

(1) A decrease in the replacement workability of the oil control valve 10 is prevented or reduced. The above-described embodiment may be, for example, modified into the following alternative embodiments.

Figure 4:
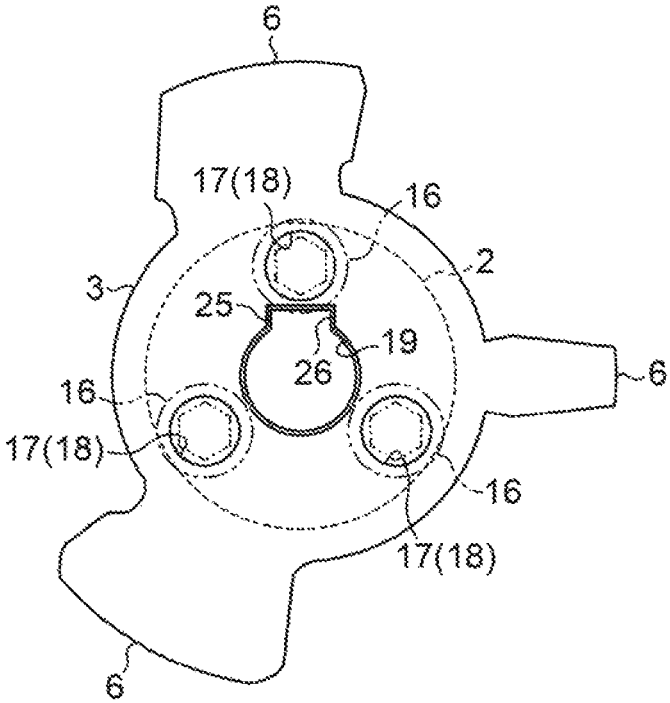
FIG. 4 is a schematic view that shows another example of a mode in which the oil control valve is mounted on the rotor of the variable valve timing mechanism.

The stay 20 does not always need to be used in order to fix the oil control valve 10 to the rotor 3. For example, as shown in FIG. 4, a protrusion 25 that protrudes in a direction away from the center line of the oil control valve 10 is provided on the outer wall of the oil control valve 10, and a groove 26 for inserting the protrusion 25 is provided on the inner periphery of the rotor 3. These protrusion 25 and groove 26 have such a shape that these protrusion 25 and groove 26 extend in the center line direction of the oil control valve 10, and are relatively movable in the center line direction in a state where side walls of both protrusion 25 and groove 26 are in contact with each other.

When one or some (one bolt 16 in this example) of the plurality of bolts 16 for fixing the rotor 3 to the camshaft 2 is screwed into a corresponding one of the threaded holes 18 of the camshaft 2 through a corresponding one of the holes 17 of the rotor 3, the oil control valve 10 is pressed into the accommodation bole 19 via the protrusion 25 by the head of the bolt 16. In this case, the hole 17, the threaded hole 18, the protrusion 25 and the groove 26 are provided such that the oil control valve 10 is fixed to the rotor 3 by screwing the bolt 16.

As described above, positioning of the oil control valve 10, fixed to the rotor 3, in the center line direction is achieved by pressing the oil control valve 10 into the accommodation hole 19 by using the head of the bolt 16. Positioning of the oil control valve 10 in the rotation direction around the center line at this time is achieved by contact of the side walls of the protrusion 25 and groove 26 with each other.

When the protrusion 25 is provided at rotor 3 and the groove 26 is provided at the oil control valve 10 as well, positioning of the oil control valve 10 in the rotation direction around the center line is achieved. In this case, it is difficult to press the oil control valve 10 into the accommodation hole 19 by using the head of the bolt 16, so it is conceivable to additionally provide a stay, or the like, that is fixed to the rotor 3 and that presses the oil control valve 10 into the accommodation hole 19 as a result of screwing the bolt 16.

The intake camshaft is illustrated as the camshaft 2. Instead, an exhaust camshaft may be employed as the camshaft 2. In this case, the variable valve timing mechanism 1 functions to change the valve timing of an exhaust valve that is the engine valve by changing the relative rotation phase of the exhaust camshaft with respect to the crankshaft.

The number of bolts 16 for fixing the rotor 3 to the camshaft 2 may be changed as needed. For example, two or four or more bolts 16 may be used.

What is claimed is:

1. A variable valve actuation apparatus for an internal combustion engine, the variable valve actuation apparatus comprising:

a variable valve timing mechanism including a rotor fixed to one end of a camshaft of the internal combustion engine; and an oil control valve configured to control hydraulic pressure that acts on the rotor, wherein the rotor is fixed to the one end of the camshaft by a plurality of bolts, and the oil control valve is fixed to the rotor by at least one of the plurality of bolts.

2. The variable valve actuation apparatus according to claim 1, wherein the oil control valve is inserted in an accommodation hole provided at a center of the rotor, and the oil control valve is fixed to the rotor by pressing the oil control valve into the accommodation hole with a use of a stay fixed to the rotor by the at least one of the plurality of bolts.

3. The variable valve actuation apparatus according to claim 2, wherein the stay has a hole for allowing the at least one of the plurality of bolts to extend through the hole, and the oil control valve is positioned with respect to the rotor as a result of plane contact of the stay with flat faces of the oil control valve.

4. The variable valve actuation apparatus according to claim 1, wherein the oil control valve is inserted in an accommodation hole provided at a center of the rotor, and the oil control valve is fixed to the rotor by pressing the oil control valve into the accommodation hole with a use of a head of the at least one of the plurality of bolts via a protrusion of the oil control valve.

5. The variable valve actuation apparatus according to claim 4, wherein the protrusion of the oil control valve protrudes from an outer wall of the oil control valve in a direction away from a center line of the oil control valve, a groove in which the protrusion is inserted is provided on an inner periphery of the rotor, and the oil control valve is positioned with respect to the rotor by contact of a side wall of the protrusion with a side wall of the groove.

* * * * *